US011548599B1

(12) United States Patent
Liu et al.

(10) Patent No.: US 11,548,599 B1
(45) Date of Patent: Jan. 10, 2023

(54) POSITIONING AND WELDING METHOD FOR A SHIP STERN THRUSTER

(71) Applicant: Zhejiang International Maritime College, Zhoushan (CN)

(72) Inventors: Zailiang Liu, Zhoushan (CN); Jianhua He, Zhoushan (CN)

(73) Assignee: Zhejiang International Maritime College, Zhoushan (CN)

( * ) Notice: Subject to any disclaimer, the term of this patent is extended or adjusted under 35 U.S.C. 154(b) by 0 days.

(21) Appl. No.: 17/853,893

(22) Filed: Jun. 29, 2022

(30) Foreign Application Priority Data

Jul. 1, 2021 (CN) ..... 202110741963.7

(51) Int. Cl.
*B63B 73/20* (2020.01)
*B63B 73/43* (2020.01)

(52) U.S. Cl.
CPC ..... *B63B 73/20* (2020.01); *B63B 73/43* (2020.01)

(58) Field of Classification Search
CPC ..... B63B 73/00; B63B 73/10; B63B 73/20; B63B 73/40; B63B 73/43; B63B 73/50; B63B 73/60; B63B 73/70
USPC ..... 219/136, 151; 114/79 W; 440/49, 76
See application file for complete search history.

(56) References Cited

U.S. PATENT DOCUMENTS 4,230,421 A * 10/1980 Springett ..... B63B 35/03 405/166
4,345,855 A * 8/1982 Uyeda ..... F16L 1/203 405/166
6,047,781 A * 4/2000 Scott ..... E21B 19/002 175/7
6,056,478 A * 5/2000 Martin ..... F16L 1/203 405/158
6,848,382 B1 2/2005 Bekker
8,382,538 B1 2/2013 Williams
10,730,499 B2 8/2020 Otremba et al.

* cited by examiner

*Primary Examiner* — Daniel V Venne
(74) *Attorney, Agent, or Firm* — True Shepherd LLC; Andrew C. Cheng

(57) ABSTRACT

This invention discloses a positioning and welding method for a ship stern thruster that relates to the technical field of ship manufacturing. A stern thruster is installed after adjusting and cutting hull stiffener panels according to the fitting condition of a prosthesis and a hull stiffener panel. The actions of manufacturing and installing the model, positioning the model structure by setting wire, adjusting the fitting condition of the model's stiffener panel and the hull stiffener panel can make it convenient to set wire and make it accurate to position the model. So the stern thruster is easy to install. The model can be repeatedly used, and the method is suitable for quantitative production.

8 Claims, 8 Drawing Sheets

POSITIONING AND WELDING METHOD FOR A SHIP STERN THRUSTER

CROSS-REFERENCE TO RELATED APPLICATIONS

This application claims priority to Chinese Patent Application No. 202110741963.7 with a filing date of Jul. 1, 2021. The content of the aforementioned applications, including any intervening amendments thereto, are incorporated herein by reference.

TECHNICAL FIELD

The present invention relates to the technical field of ship manufacturing, and in particular, to the field of positioning and welding methods for a ship stern thruster.

BACKGROUND

Ship stern push devices mainly include a propeller, an adjustable propeller, a jet propeller, and the like, and are a power source of the ship. When the ship is manufactured, in order to ensure that the hull platform plate meets the installation requirements of the stern push device, the hull can be slightly inclined; the installation plane of the stern push device is an inclined plane. When the stern push equipment is installed, the position of the hull rib plate and the position of the equipment rib plate are adjusted at the same time; so setting wire is inconvenient, which causes the problem that equipment positioning is difficult and inaccurate.

SUMMARY

In view of the above problem, the following technical solution provides a positioning and welding method for a ship stern thruster and aims to solve the problem of difficult positioning and inaccurate positioning of a stern thruster.

A positioning and welding method for a ship stern thruster, includes the following steps:

step 1, a model of a stern thruster is manufactured according to a theoretical size of a butt seam between the stern thruster and a hull construction;

step 2, the model is positioned by setting a steel wire through a main deck technological hole, a hull platform plate hole, and a bottom plate hole according to requirements on installation position and installation angle of the stern thruster; and a hull platform plate and a bottom plate are proofed according to a position of the steel wire; and the steel wire is vertical to the hull platform plate and the bottom plate; and holes at platform plate and the bottom plate are cut by taking the steel wire as a centre line;

step 3, the steel wire is removed; the model is lifted to a cavity structure through the main deck technological hole; the platform plate hole and the bottom plate hole are matched with upper and lower closing plates of the model respectively; the steel wire is set again to make the steel wire passes through centers of upper and lower closing plates of the model; and the upper and lower closing plates are vertical to the steel wire; the model is technologically rotated around the steel wire, and side stiffener panels of the model fit hull stiffener panels;

step 4: positions of the hull stiffener panels are readjusted according to a fitting condition between model's stiffener panels and hull stiffener panels to make model's side stiffener panel fit hull stiffener panels; a butt line is scribed on an overlap between the hull stiffener panels and the model's stiffener panels, and cutting an excess of the hull stiffener panels along the butt line; positions and angles of the hull stiffener panels are adjusted according to positions of the model's stiffener panels; and the model's stiffener panels and the hull stiffener panels are combined and in a same plane; the model is hoisted off after welding work of the hull stiffener panels and hull structure;

step 5, a line is set based on rims of an upper and a lower flange of the stern thruster; the excess of stern thruster fortified plates is cut along the line; the stern thruster is hoisted to the cavity structure; adjusting a position and angle of the stern thruster to enable the stern thruster fortified plates to be completely combined with the hull stiffener panels; an overlap between the stern thruster fortified plates and the hull stiffener panels are cut with reference to step 4; adjusting an angle of the stern thruster, enable the stern thruster fortified plates to be completely aligned with the hull stiffener panels; and keeping a gap between an upper flat panel of the stern thruster and the hull platform plate is identical to a gap between a lower flat panel of the stern thruster and the bottom plate; and step 6, tack welding and fixing upper and lower flanges of the stern thruster respectively to the hull platform plate and the bottom plate.

In a preferred embodiment, the main deck technological hole is provided with a buttress bracing struts for determining an upper locating point.

In a preferred embodiment, the buttress bracing struts are angle steel or U-steel.

In a preferred embodiment, wire shelves are arranged at two ends of the steel wire.

In a preferred embodiment, the upper and lower closing plates of the model are provided with starting screw for adjusting positioning.

In a preferred embodiment, when cutting the excess of the hull stiffener panels in step 4, the model is driven up or lifted away from the cavity structure, and the model is hoisted to the cavity structure after the cutting is completed.

In a preferred embodiment, in step 5, the stern thruster fortified plates are added with an excess of 30 mm as a pre-cut line, and the excess of the stern thruster fortified plates is cut along the pre-cut line.

In a preferred embodiment, in step 6, $CO_2$ multi-layer welding is adopted, and a welding sequence is that the welding is performed on a diagonal symmetry of a flange surface.

Advantages Effects of Preferred Embodiments

Adjusting and cutting hull stiffener panels according to the fitting condition of a prosthesis and a hull stiffener panel, and then a stern thruster is installed; by manufacturing, installing the model, positioning the model structure by setting wire, adjusting the fitting condition of the model's stiffener panel and the hull stiffener panel, setting wire is convenient, the positioning is accurate, the stern thruster is easy to install. The model can be repeatedly used, and the method is suitable for quantitative production.

DESCRIPTION OF THE DRAWINGS

In order that the invention may be understood more easily, an embodiment according to the invention, by way of example, will now be described by referring to the drawings.

Figure 1:
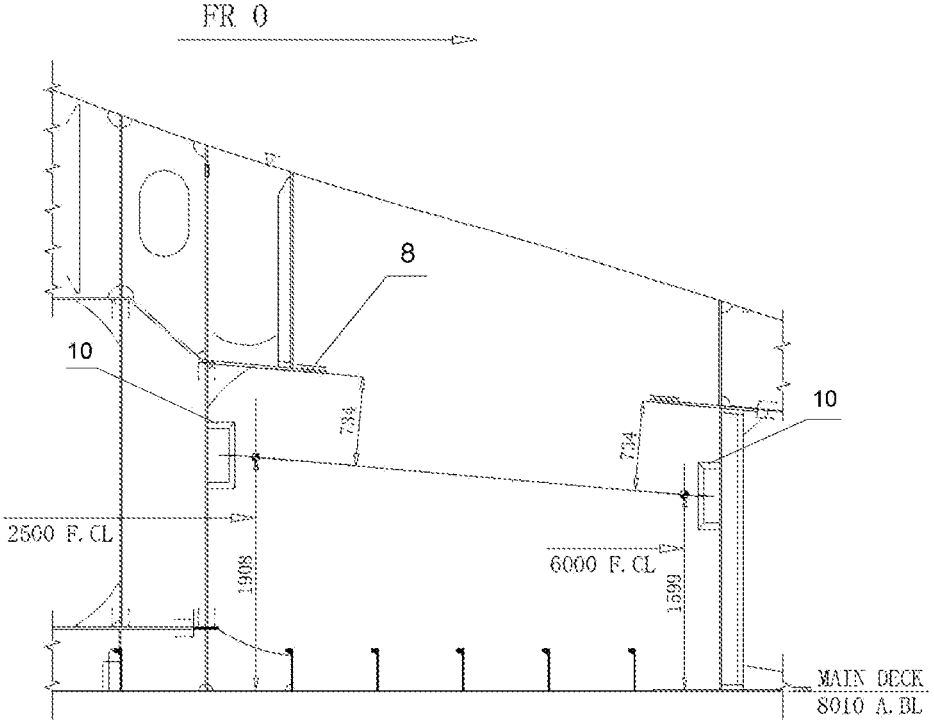
FIG. 1 is a diagram of positioning a hull platform plate along a wide line of the hull according to an embodiment.

In the drawings, 1—model, 2—upper starting screw, 3—lower starting screw, 4—upper wire shelve, 5—buttress bracing strut, 6—main deck technological hole, 7—steel wire, 8—hull platform plate, 9—bottom plate, 10—wire shelve, 11—upper flange, 12—academic butt line, 13—pre-cutting line, 14—lower flange, 15—upper closing plate, 16—lower closing plate, 17—side stiffener panel, 18—hull stiffener panel.

DETAILED DESCRIPTION OF PREFERRED EMBODIMENTS

Embodiments of the present invention will be further described below with reference to the accompanying drawings.

Figure 2:
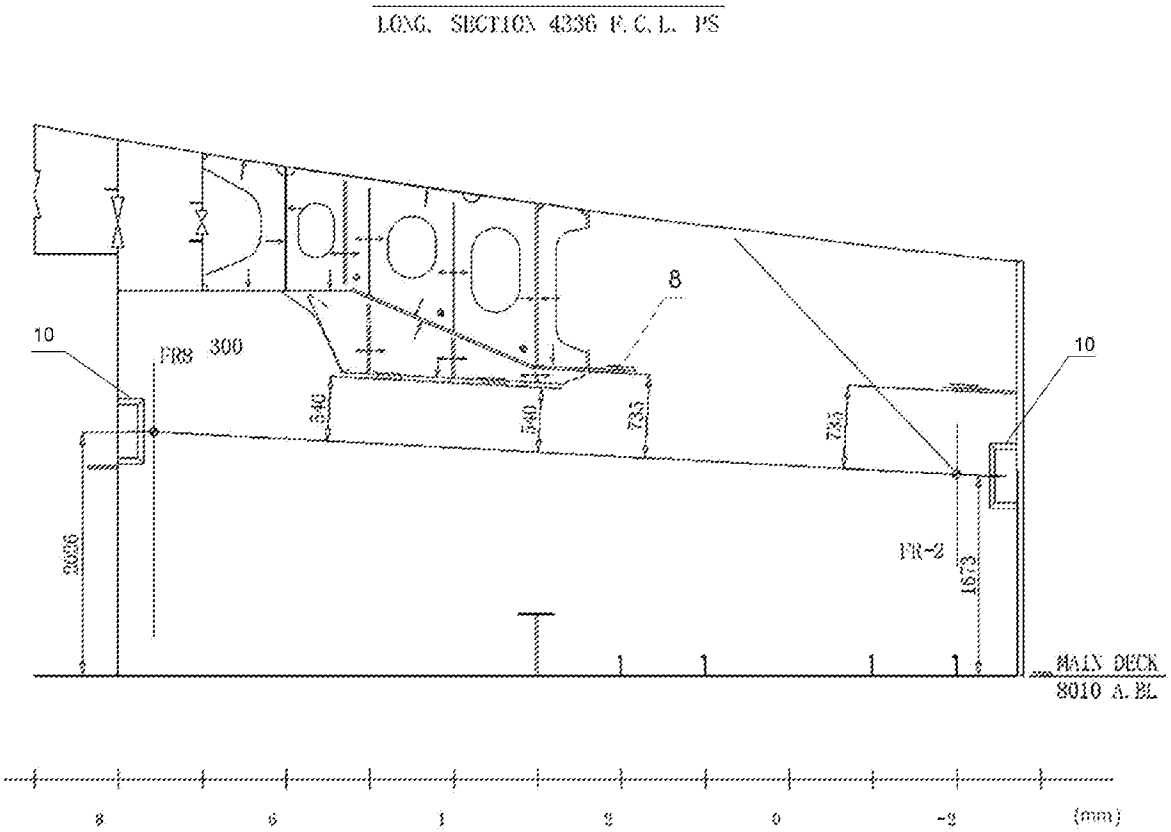
FIG. 2 is a diagram of positioning a hull platform plate along a long line of the hull according to an embodiment.

Taking the S1049 liquefied gas ship stern thruster as an example. Before the stern thruster is installed, the splicing work of the platform plate needs to be completed. The platform plate needs to be leveled, the flatness tolerance is ±2 mm. The section of the stern thruster is installed reversely; the ship body platform plate is hoisted to the section for positioning. In order to ensure that the hull platform plate meets the installation requirements that are fore and aft deflection of 5 degrees and the left and right offset of 3 degrees, the ship hull platform plate needs to be positioned by setting wire along the width direction and the length direction of the ship, which is shown in FIGS. 1 and 2, the specific positioning data is as follows:

Along the beam of ship (along the width): amidship locating point (2500 of CL) X=FR0, Y=±2500, Z=6092 (from baseline,A.BL), 1908 (from the main deck, not including deck thickness);

starboard side locating point: X=FR 0, Y=±6000,

Z=6399 (from baseline,A.BL), 1599 (from the main deck, not including deck thickness);

And it is ensured that the linear distance between the platform plate and the steel wire is 734±2 mm;

Along the length: stem locating point X=FR8$^{-300}$, Y=±4336,

Z=5974 (from baseline,A.BL), 2026 (from the main deck, not including deck thickness);

stern locating point: X=FR-2, Y=±4336,

Z=6327 (from baseline,A.BL), 1673 (from the main deck, not including deck thickness);

And it is ensured that the linear distance between the platform plate and the steel wire is 735±2 mm.

Figure 3:
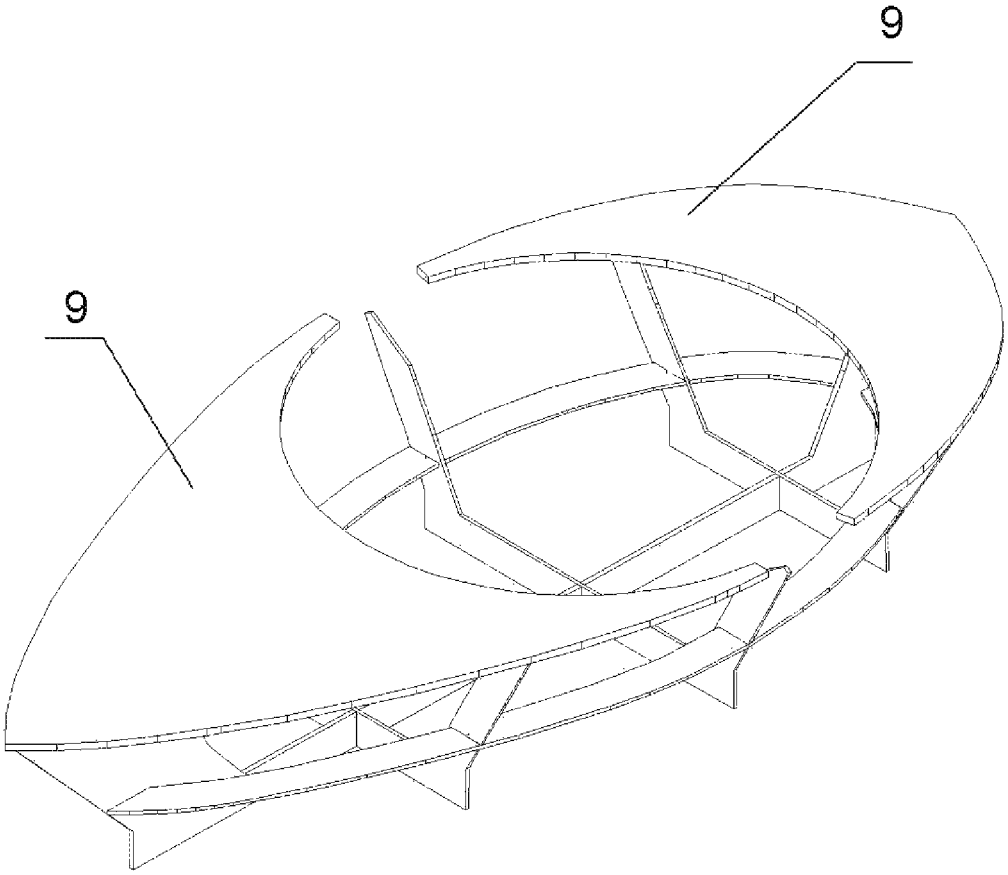
FIG. 3 is a diagram of installation of a hull platform plate according to an embodiment.
Figure 4:
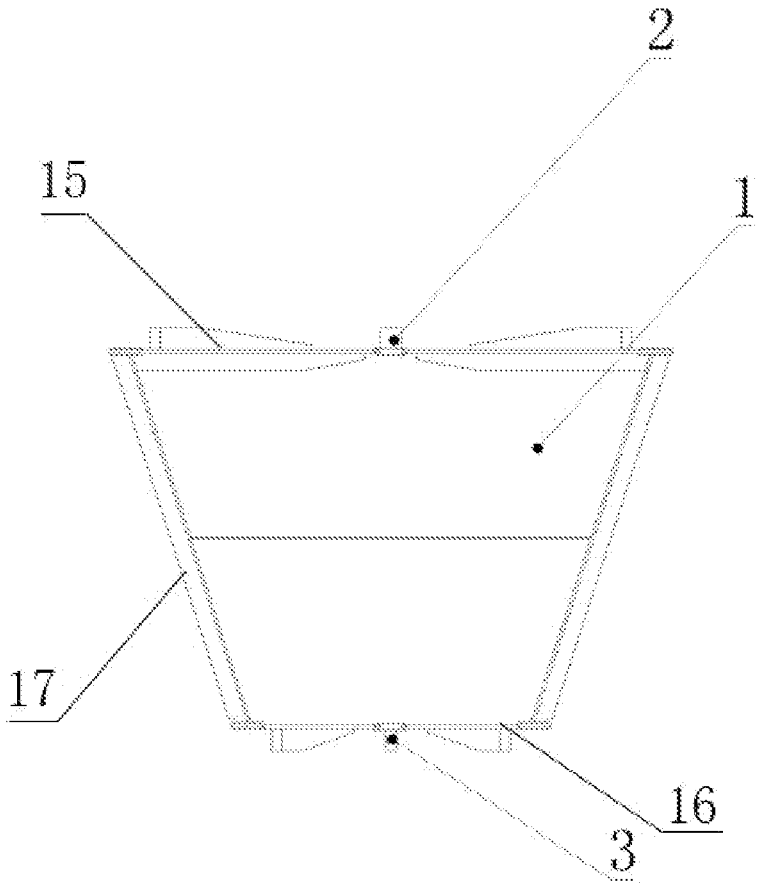
FIG. 4 is a front view of a model according to an embodiment.
Figure 5:
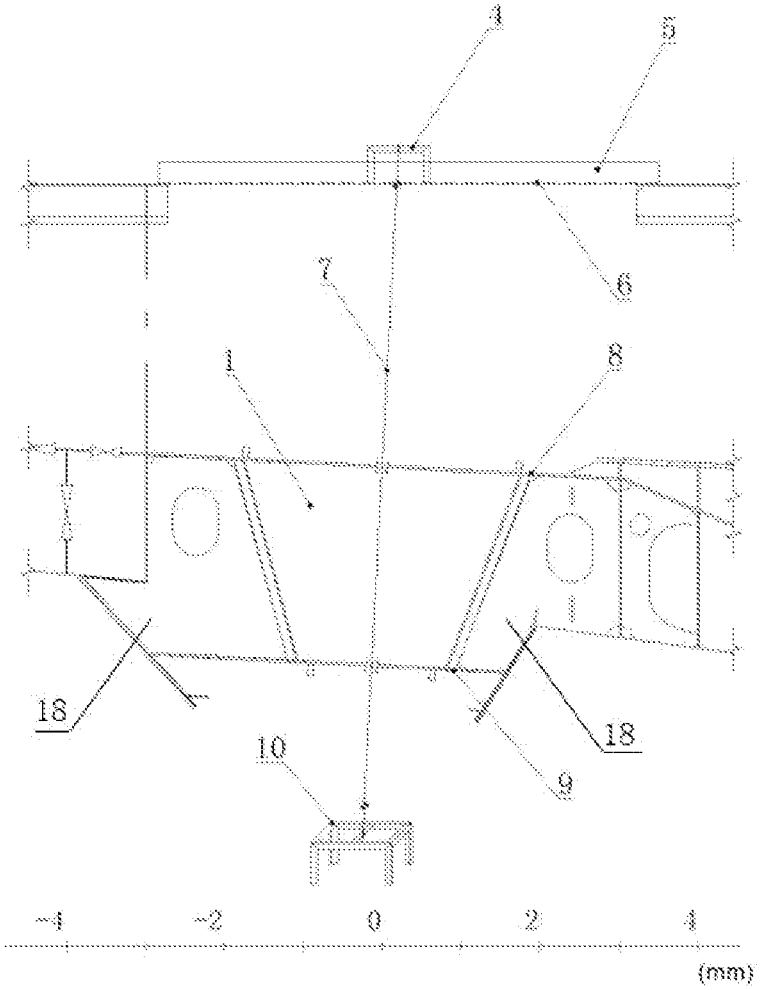
FIG. 5 is a diagram of positioning by a wire of a model according to an embodiment.
Figure 6:
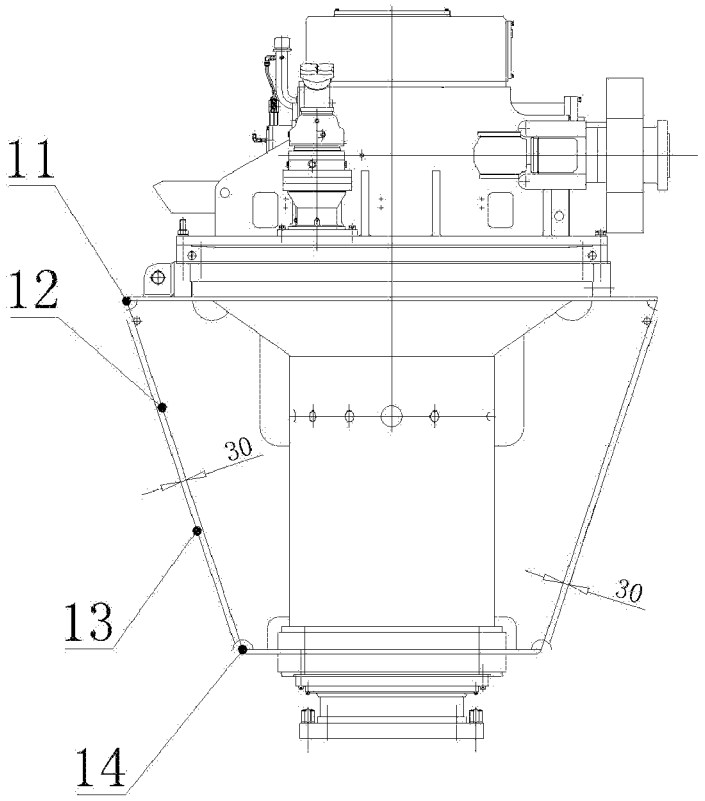
FIG. 6 is a pre-cut diagram of a stiffener panel of a stern thruster according to an embodiment.
Figure 7:
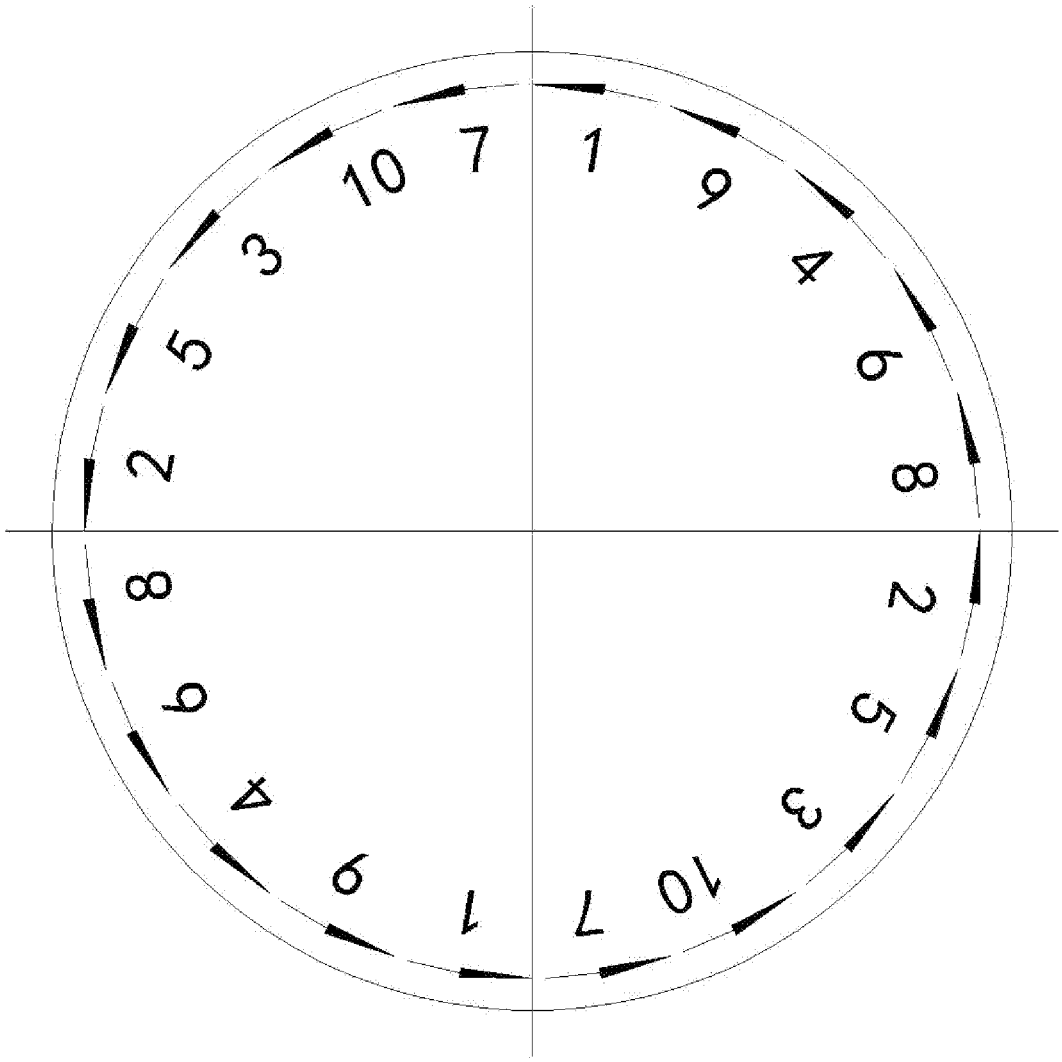
FIG. 7 is a diagram of a welding sequence of a flange surface of a stern thruster according to an embodiment.
Figure 8:
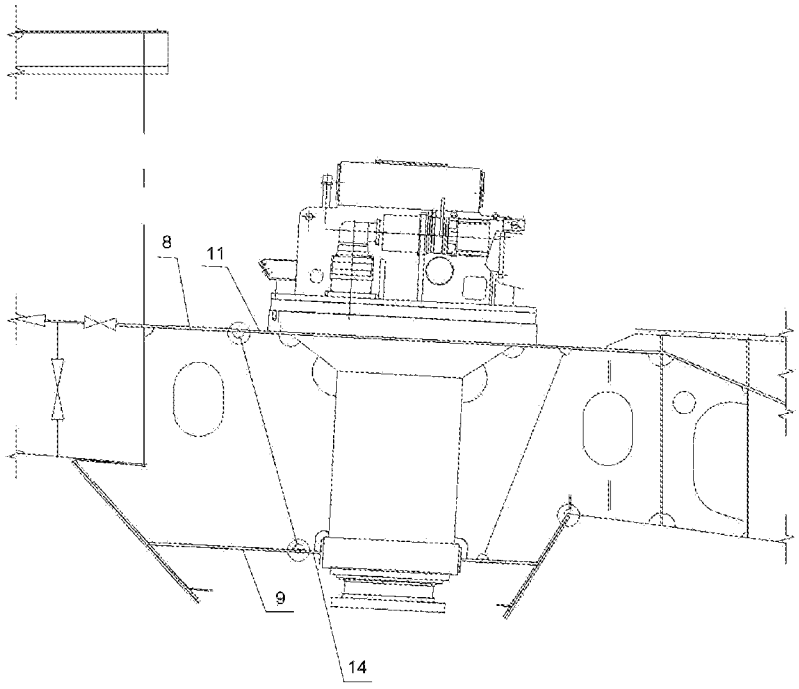
FIG. 8 is a diagram of a stern thruster installed on a hull according to an embodiment.

As shown in FIG. 3, after positioning and welding the hull platform board according to the above-mentioned stay wire requirements, the section is turned over and set horizontalization to meet the equipment installation requirement, and then the stern thruster is positioned and welded.

As shown in FIGS. 4,5,6,7, and 8, the positioning and welding method for a ship stern thruster, comprising the following steps:

step 1, manufacturing a model according to a theoretical size of a butt seam between the stern thruster and a hull construction; The model is of a circular truncated cone structure, a part close to the hull platform plate is a wide part of the circular truncated cone structure, a part close to the bottom plate of the hull is a narrow part of the circular truncated cone structure, and starting screws are arranged on the upper and lower closing plates of the prosthesis and are used for adjusting and positioning the model.

Step 2, positioning by setting a steel wire through a main deck technological hole, a hull platform plate hole, and a bottom plate hole according to requirements on installation position and installation angle of the stern thruster. At this time, the main deck has been cut a hole, and the buttress bracing struts can be welded at the main deck technological hole to determine the upper locating point; in order to prevent twisting and drooping, the buttress bracing struts is made of materials such as angle steel, U-steel and the like; and a wire shelf is arranged up and down, and the three-dimensional positioning data of the upper and lower locating point on the steel wire is as follows:

upper locating point: X=FR0$^{-131}$, Y=±4183, Z=8010 (from baseline);

lower locating point: X=FR0$^{-158}$, Y=±4665, Z=2500 (from baseline).

Proofing a hull platform plate and the bottom plate according to the steel wire position, and the allowable flatness tolerance is ±3 mm. Make the steel wire vertical to the hull platform plate and the bottom plate, and cut the holes on the platform plate and the bottom plate by taking the steel wire as the centre line. After cutting, the hole size of the platform plate is 02650-3 mm; the hole size of the bottom plate is 01490-3 mm.

Step 3, removing the steel wire, lifting the model to a cavity structure through the main deck technological hole, matching the platform plate hole and the bottom plate hole with upper and lower closing plates of the model respectively, setting the steel wire again to make the steel wire passes through centers of the upper and lower closing plates of the model, and making the upper and lower closing plates vertical to the steel wire; technological rotating the model around the steel wire and making side stiffener panels of the model fit hull stiffener panels.

Step 4, readjusting positions of the hull stiffener panels according to a fitting condition between the model's stiffener panels and the hull stiffener panels to make model's side stiffener panel fit hull stiffener panels; scribing an butt line on an overlap between the hull stiffener panels and the model's stiffener panels; before scribing, ensure that the end of the hull stiffener panels away from the equipment is positioned accurately, and the hull stiffener panels are fixed by drop welding, then cut the margin of the hull stiffener panels along the drawn butt line; in order to ensure that the model's stiffener panel is not damaged during cutting and enough construction space, the model is raised or lifted away when the hull structure stiffener panel is being cut, and the model is again in place after cutting is completed, adjusting the positions and angles of the hull stiffener panels according to positions of the model's stiffener panels, and enabling the model's stiffener panels and the hull stiffener panels to be combined and to be in a same plane; hoisting off the model after welding work of the hull stiffener panels and the hull structure.

Step 5, setting a line based on rims of an upper and a lower flange of the stern thruster. That line is the academic butt line of the stern thruster and the hull stiffener panel. In order to ensure precise combination, the device fortified plates can be added with a 30 mm margin as a pre-cut line. Cutting the excess of stern thruster fortified plates along the line, hoisting the stern thruster to the cavity structure, adjusting a position and angle of the stern thruster to enable the stern thruster fortified plates to be completely combined with the hull stiffener panels; cutting an overlap between the stern thruster fortified plates and the hull stiffener panels with reference to step 4, adjusting the angle of the stern thruster, enabling the stern thruster fortified plates to be completely aligned with the hull stiffener panels, and keeping a gap between an upper flat panel of the stern thruster and the hull platform plate to be identical to a gap between a lower flat panel of the stern thruster and the bottom plate;

Step 6, tack welding and fixing the upper and lower flanges of the stern thruster respectively to the hull platform plate and the bottom plate. $CO_2$ multi-layer welding is adopted. $CO_2$ multi-layer welding includes backing welding and cosmetic welding. The backing welding current cannot exceed 220 A, the cosmetic welding current cannot exceed 250 A. The welding length of the welding seam is about 300 mm, and the height of the welding seam is about 3 mm. After the first welding seam is completed, welding is carried out on the diagonal line of the flange surface, and the weld joints of the multi-pass welding are staggered. Repeat that until the upper and lower flange is respectively backing welded with the hull platform plate and the bottom plate, and do cover welding, so that the upper and lower flanges are connected to the hull platform plate and bottom plate respectively and smoothly.

The embodiments should not be construed as limitations of the present disclosure, and any non-creative improvement based on the spirit of the present disclosure should be regarded as the protection scope of the present disclosure

We claim:

1. A positioning and welding method for a ship stern thruster, comprising the following steps:

step 1, manufacturing a model according to a theoretical size of a butt seam between the stern thruster and a hull construction;

step 2, positioning by setting a steel wire through a main deck technological hole, a hull platform plate hole, and a bottom plate hole according to requirements on installation position and installation angle of the stern thruster, and proofing a hull platform plate and a bottom plate according to a position of the steel wire, and making the steel wire vertical to the hull platform plate and the bottom plate, and cutting the holes at platform plate and the bottom plate by taking the steel wire as a centre line;

step 3, removing the steel wire, lifting the model to a cavity structure through the main deck technological hole, matching the platform plate hole and the bottom plate hole with upper and lower closing plates of the model respectively, setting the steel wire again to make the steel wire passes through centers of upper and lower closing plates of the model, and making the upper and lower closing plates vertical to the steel wire; technological rotating the model around the steel wire, and making side stiffener panels of the model fit hull stiffener panels;

step 4: readjusting positions of the hull stiffener panels according to a fitting condition between model's stiffener panels and hull stiffener panels to make model's side stiffener panel fit hull stiffener panels; scribing an butt line on an overlap between the hull stiffener panels and the model's stiffener panels, and cutting a excess of the hull stiffener panels along the butt line; adjusting positions and angles of the hull stiffener panels according to positions of the model's stiffener panels, and enabling the model's stiffener panels and the hull stiffener panels to be combined and to be in a same plane; hoisting off the model after welding work of the hull stiffener panels and the hull structure;

step 5, setting a line based on rims of an upper and a lower flange of the stern thruster, cutting the excess of stern thruster fortified plates along the line, hoisting the stern thruster to the cavity structure according to step 3, adjusting a position and angle of the stern thruster to enable the stern thruster fortified plates to be completely combined with the hull stiffener panels; cutting an overlap between the stern thruster fortified plates and the hull stiffener panels with reference to step 4, adjusting an angle of the stern thruster, enabling the stern thruster fortified plates to be completely aligned with the hull stiffener panels, and keeping a gap between an upper flat panel of the stern thruster and the hull platform plate to be identical to a gap between a lower flat panel of the stern thruster and the bottom plate; and step 6, tack welding and fixing upper and lower flanges of the stern thruster respectively to the hull platform plate and the bottom plate.

2. The positioning and welding method according to claim 1, wherein the main deck technological hole is provided with a buttress bracing struts for determining an upper locating point.

3. The positioning and welding method according to claim 2, wherein the buttress bracing struts are angle steel or U-steel.

4. The positioning and welding method according to claim 1, wherein wire shelves are arranged at two ends of the steel wire.

5. The positioning and welding method according to claim 1, wherein the upper and lower closing plates of the model are provided with starting screw for adjusting positioning.

6. The positioning and welding method according to claim 1, wherein when cutting the excess of the hull stiffener panels in step 4, the model is driven up or lifted away from the cavity structure, and the model is hoisted to the cavity structure after the cutting completed.

7. The positioning and welding method according to claim 1, wherein in step 5, the stern thruster fortified plates are added with an excess of 30 mm as a pre-cut line, and the excess of the stern thruster fortified plates is cut along the pre-cut line.

8. The positioning and welding method according to claim 1, wherein in step 6, $CO_2$ multi-layer welding is adopted, and a welding sequence is that the welding is performed on a diagonal symmetry of a flange surface.

* * * * *